US007958686B1

(12) United States Patent
Majocka et al.

(10) Patent No.: US 7,958,686 B1
(45) Date of Patent: Jun. 14, 2011

(54) DRAIN BODY SUPPORT PAN

(75) Inventors: Christopher A. Majocka, Erie, PA (US); David Gomo, Waterford, PA (US); Doug Wroblewski, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 720 days.

(21) Appl. No.: 11/803,342

(22) Filed: May 14, 2007

Related U.S. Application Data

(60) Provisional application No. 60/802,734, filed on May 23, 2006.

(51) Int. Cl.
*E04B 1/66* (2006.01)

(52) U.S. Cl. ..... 52/302.7; 52/302.1

(58) Field of Classification Search ..... 52/238.1, 52/239, 241, 266, 270; 4/613, 695; 285/56–60
See application file for complete search history.

(56) References Cited

U.S. PATENT DOCUMENTS

| | | | | |
|---|---|---|---|---|
| 598,992 | A | 2/1898 | Hosford | |
| 1,746,775 | A | 2/1930 | Johnson et al. | |
| 3,287,742 | A | 11/1966 | Gaddis | |
| 4,207,632 | A * | 6/1980 | Savell et al. | 4/288 |
| 4,212,486 | A | 7/1980 | Logsdon | |
| 5,140,789 | A * | 8/1992 | De Gooyer | 52/71 |
| 5,154,024 | A | 10/1992 | Noel | |
| 6,076,559 | A | 6/2000 | Castillo et al. | |
| 6,833,067 | B2 * | 12/2004 | Dresmann | 210/163 |
| 2003/0159384 | A1 * | 8/2003 | Warnecke | 52/302.1 |
| 2005/0166315 | A1 * | 8/2005 | Warnecke et al. | 4/695 |
| 2007/0056088 | A1 * | 3/2007 | DeGooyer | 4/613 |

OTHER PUBLICATIONS

Web site pages for floor drains manufactured by Zurn Industries, Inc., available at www.zurn.com © 2003.
Installation instructions for Z-415 floor drain manufactured by Zurn Industries, Inc., Form FD15, C.N. No. 83044, Aug. 5, 1999, available at http://www.zurn.com/operations/specdrain/pdfs/installation/fd15.pdf.
Body Assembly specification sheet for Z415B Zurn floor drain, Rev. G, C.N. No. 92376, Jul. 15, 2004, available at: http://www.zurn.com/operations/specdrain/pdfs/specsheets/58789.pdf.
Sump Depth specification sheet for Z1900 Zurn Floor drain, Rev. E, C.N. No. 91655, Nov. 17, 2003, available at: http://www.zurn.com/operations/specdrain/pdfs/specsheets/59341.pdf.
Sump Depth specification sheet for Z1901 Zurn Floor drain, Rev. E, C.N. No. 91656, Nov. 17, 2003, available at: http://www.zurn.com/operations/specdrain/pdfs/specsheets/59342.pdf.
Sump Depth specification sheet for Z1902 Zurn Floor drain, Rev. E, C.N. No. 91657, Nov. 17, 2003, available at: http://www.zurn.com/operations/specdrain/pdfs/specsheets/59343.pdf.
Zurn, "Specification Drainage Engineering Guide Sani-Flor Receptors", www.zurn.com, Aug. 2004 (28 pgs.).

* cited by examiner

*Primary Examiner* — Brian E Glessner
*Assistant Examiner* — Adam Barlow
(74) *Attorney, Agent, or Firm* — The Webb Law Firm

(57) ABSTRACT

A drain support pan assembly has a drain body support pan which has a rectangular-shaped body connected to a rectangular-shaped drain receptacle body for use in floor drains. The distance between the support pan and receptacle body can be adjusted according to the depth of the floor space by selecting a predetermined length for the fasteners. The support pan has a center passageway for receiving a drain pipe and several slots that align with threaded passageways in the receptacle body for receiving the fasteners. The support pan contains concentric knock-out sections which can be removed for enlarging the diameter of the center passageway to accommodate varying diameter drain pipes or pipe connections for particular use in a deep floor space, and also has a rectangular knock-out section which can be removed for receiving the rectangular-shaped drain receptacle for use in a narrow floor space.

16 Claims, 8 Drawing Sheets

DRAIN BODY SUPPORT PAN

CROSS REFERENCE TO RELATED APPLICATION

This application claims the benefit of U.S. Provisional Patent Application No. 60/802,734 filed May 23, 2006, on which priority of this non-provisional patent application is based, and which is hereby incorporated by reference in its entirety.

BACKGROUND OF THE INVENTION

1. Field of the Invention

The present invention relates to floor drains and, more particularly, to a floor drain body support pan or plate, a drain support plate assembly which includes the drain support plate adjustably attached to a receptacle body of the drain, and to a method for installing the drain body support pan assembly into a floor structure.

2. Description of the Prior Art

Presently, floor drains are installed utilizing a drain receptacle body that receives a clamp collar, which, in turn, receives either a dome or frame, or receives a frame which also serves as a clamp collar for receipt of a grate. Such prior art floor drain arrangements are manufactured, for example, by Zurn Industries, Inc. in Erie, Pa.

FIGS. 1 and 2 illustrate a typical floor drain 10 of the prior art that includes a receptacle body 12. The receptacle body 12 has a first end 14 and a pipe receiving second end 16, which defines a body cavity 20. The first end 14 of the receptacle body 12 includes an annular flange 22 extending away from the body cavity 20 of the receptacle body 12. A plurality of spaced apart protrusions 24, preferably four (two are shown and two on an opposite side are not shown in FIGS. 1 and 2), is defined adjacent the first end 14 of the receptacle body 12 underneath the annular flange 22. Protrusions 24 extend in a direction away from the cavity 20 of the receptacle body 12. Each protrusion 24 defines a passageway 26 which may be internally threaded and adapted to receive a fastener F shown in phantom in FIG. 1. The second end 16 of the receptacle body 12 is adapted to fasten to a drain pipe P shown in phantom in FIG. 2.

FIGS. 1 and 2 also show a prior art method of installing the prior art floor drain 10 in a floor structure. First, a bore is cut in a block S, preferably made of Styrofoam and the second end 16 of the receptacle body 12 is placed within the bore of the block S (shown in FIG. 1). The block S is then placed on a wooden board B, such as plywood, and a wire W is wrapped around the receptacle body 12 and secured to the board B via a nail N, as shown in FIG. 1. Referring to FIG. 2, concrete C is then poured around the receptacle body 12 and the block S and allowed to set. The board B is then removed from underneath the floor structure and the block S is chiseled away from the concrete C, thereby creating a void V between the concrete C and the second end 16 of the receptacle body 12. The wire W is left embedded in the concrete C and any protruding wires W or nails N are trimmed.

One drawback to the prior art method of installing the prior art floor drain 10 is that distance or height H (shown in FIG. 1) between the first end 14 of the receptacle body 12 and the board B cannot be adjusted without either cutting the block S or replacing the block S with a smaller or larger block depending on the desired height H. Another drawback to the prior art method is that the installation time of the floor drain 10 of the prior art is increased since the block S has to be chiseled away for removal from the embedded concrete C.

Therefore, it is an object of the present invention to overcome the above-mentioned drawbacks by providing an adjustable floor drain arrangement that is easy to install.

FIGS. 3-7 also pertain to a drain floor support pan or plate 30 and a drain support plate assembly of the prior art of pending U.S. patent application Ser. No. 11/012,894, filed Dec. 15, 2004. However, a detailed discussion of these FIGS. 3-7 will be given in describing the invention since the present invention is easily adaptable in the environment of the invention of the U.S. patent application Ser. No. 11/012,894 ('894).

One drawback to the prior art of the '894 patent application is that since the pan 30 has concentric score lines 56, which are punched out to accommodate the diameter of the drain pipe, the drain pan 30 can not be interchangeably used in a floor drain for accommodating either a rectangular profile, e.g., a receptacle body or a circular profile, e.g., a drain pipe.

Therefore, it is a further object of the present invention to overcome the above drawback of the '894 patent by providing a drain body support pan and assembly which can be interchangeably used to accommodate varying shaped and sized profiles such as a rectangular receptacle body or a circular drain pipe.

SUMMARY OF THE INVENTION

The present invention provides for a drain body support pan or plate adapted to be fastened to a receptacle body of a drain. The drain body support pan includes a body having an inner surface and an outer surface defining a first portion and a second portion. The first portion of the body defines a peripheral edge. The second portion of the body is attached to the peripheral edge of the first portion and axially extends therefrom. The inner surface of the first portion and the second portion of the body defines an interior cavity. The first portion of the body of the support pan defines a center passageway that is spaced radially away from the peripheral edge and that is adapted to receive a pipe and/or pipe connection. The first portion of the body also defines at least one slot adapted to be aligned with the receptacle body for receiving a fastener for attaching the receptacle body to the body of the support pan. At least one first geometric shaped knock-out section indicated by perforations is also defined on the first portion of the drain body support pan adjacent and concentric to the center passageway of the support pan. This knock-out section may be removed from the support pan to enlarge the diameter of the central passageway to accommodate the varying diameter of the pipe and/or pipe connection of the receptacle body of the drain. Additionally, at least one second geometric shaped knock-out section is provided on the first portion of the support pan axially located outwardly from the center passageway of the support pan. This second geometric shaped knock-out section may be removed from the first portion of the body of the support pan to accommodate the receptacle body of a drain. This second geometric shaped knock-out section, when removed from the support pan, also includes removal of the central passageway and the first geometric shaped knock-out section or sections defined in the first portion of the body surrounding the central passageway of the support pan. The support pan is configured so that either the central passageway may be used to receive a pipe connection or drain pipe or the second geometric shaped knock-out section of the support pan may be removed to receive the receptacle body of a drain. If the diameter of the pipe connection or drain pipe is greater than the diameter of the central passageway, then one or more first geometric shaped knock-out sections may be removed from the support pan. Preferably, the geometric shape of the first geometric shaped knock-out sections have a different shape than the second geometric shaped knock-out.

The present invention also provides a drain body support pan assembly that includes the receptacle body of a drain and the drain support pan as discussed hereinabove. The receptacle body includes a first end and a second end, wherein the first end defines at least one passageway adapted to receive a fastener and the second end of the receptacle body is adapted to fasten to a pipe. The drain body support pan is attached to the receptacle body via the fastener which extends through a slot in the first portion of the body of the support pan and a passageway associated with the receptacle body. The drain body support pan assembly further includes a pipe connection attached to the second end of the receptacle body, wherein the pipe connection extends through the body of the support pan. The pipe connection is adapted to be fastened to a drain pipe. A pipe spacer may also be positioned around the second end of the receptacle body, wherein the pipe spacer extends from the second end of the receptacle body toward the body of the support pan.

The present invention further provides for a method of installing a drain in a floor structure. The method includes the steps of providing a drain support pan assembly which includes a receptacle body of a drain adjustably attached to a drain body support pan as discussed hereinabove. The receptacle body of the drain is attached to the first portion of the support pan via one or more fasteners which connect the receptacle body to the body of the drain pan by extending through a slot in a first portion of the body of the drain pan and in a threaded passageway associated with the receptacle body. The length of the fastener will vary depending on the depth of the floor structure. For example, the length of the fasteners will generally be shorter in a narrow floor space compared to those used in a deep floor space.

For a narrow floor space, the rectangular-shaped knock-out section in the drain support pan may be removed to form a rectangular opening to accommodate and support the rectangular-shaped receptacle body. For a deep floor space, if the diameter of the pipe and/or pipe connection is about the same as that of the center passageway of the support pan, then the pipe and/or pipe connection is inserted into the center passageway. If the diameter of the pipe and/or pipe connection is greater than the diameter of the center passageway of the support pan, then one or more circular knock-out sections in the drain body support pan may be removed to form a wider circular opening in the support pan to accommodate the pipe and/or pipe connection in a deep floor space. The extent of the concentric circular knock-outs, which will be knocked out in the drain body support pan, will depend on the diameter of the pipe and/or the pipe connection.

These and other objects and advantages of the present invention will be better appreciated and understood by those skilled in the art from the following description and appended claims.

DESCRIPTION OF THE INVENTION

As stated hereinabove, FIGS. 3-7 represent a drain floor support pan or plate and a drain support plate assembly as disclosed and claimed in pending U.S. patent application Ser. No. 11/012,894 filed on Dec. 15, 2004, the teachings of which are incorporated by reference herein in their entirety. This '894 patent provides a background for a clear understanding of the invention.

Figure 3:
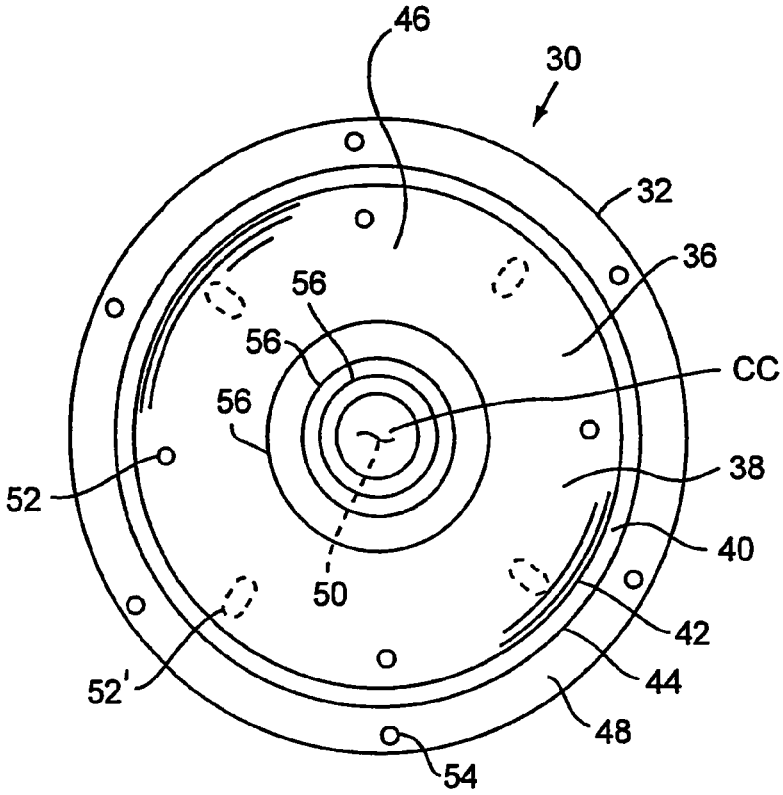
FIG. 3 (PRIOR ART)
FIG. 3 is a bottom plan view of a drain support plate of the prior art.
Figure 4:
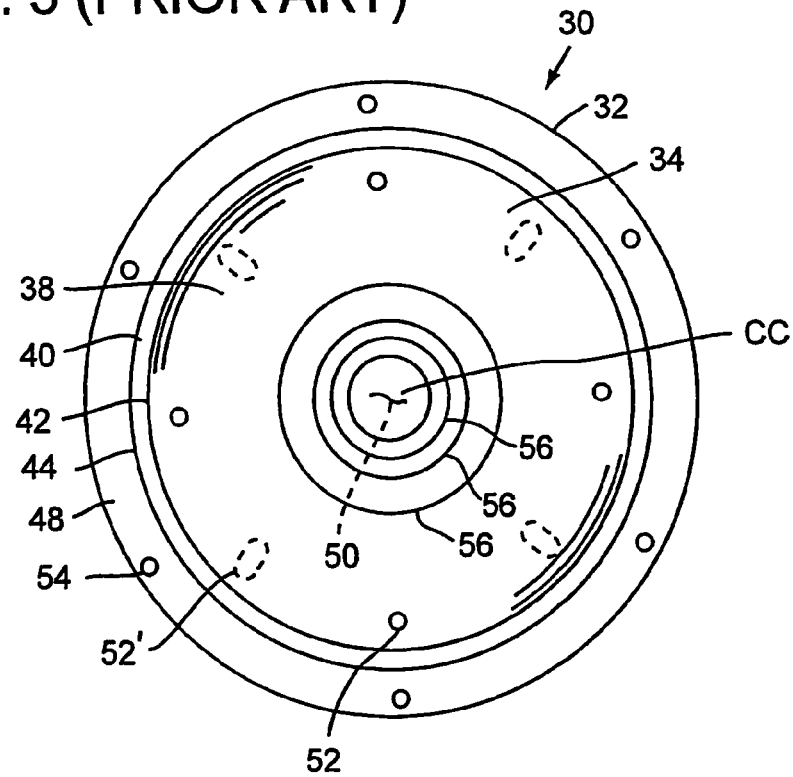
FIG. 4 (PRIOR ART)
FIG. 4 is a top plan view of the drain support plate of the prior art shown in FIG. 3.
Figure 5:
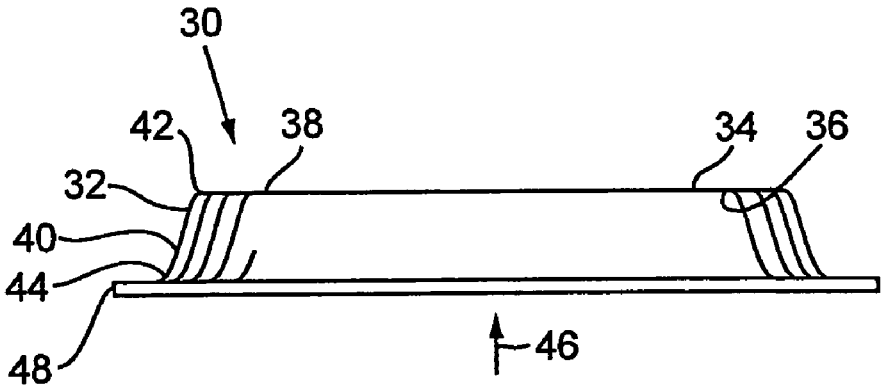
FIG. 5 (PRIOR ART)
FIG. 5 is a side elevational view of the drain support plate of the prior art shown in FIG. 3.
Figure 6:
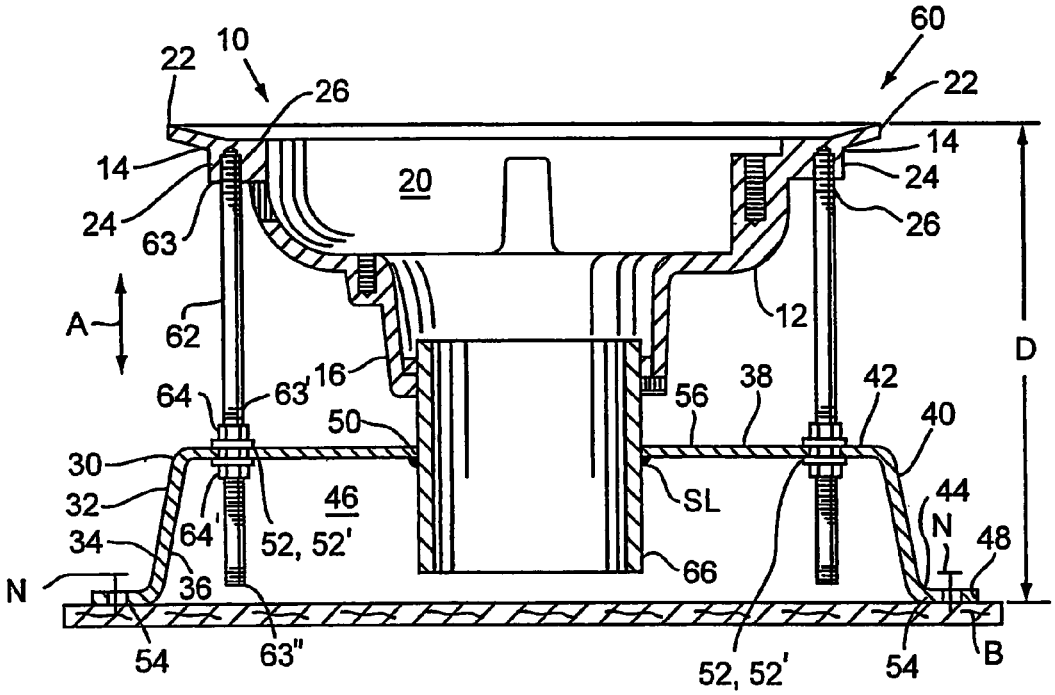
FIG. 6 (PRIOR ART)
FIG. 6 is a partial cross-sectional view showing a floor drain installation utilizing the drain support plate of the prior art shown in FIG. 3.
Figure 7:
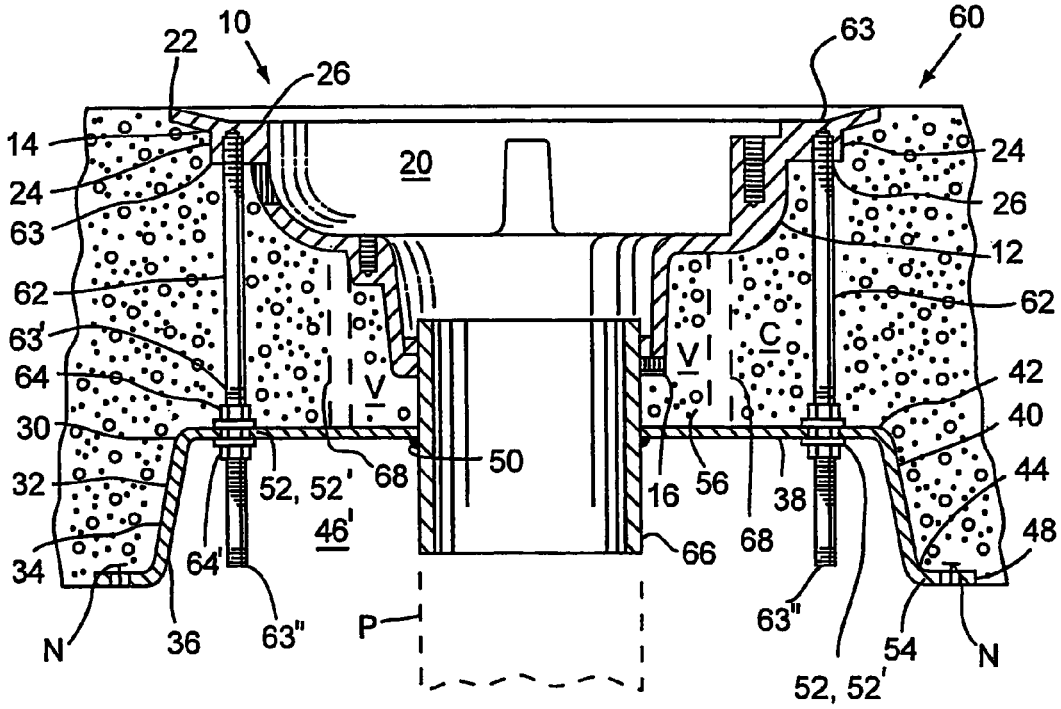
FIG. 7 (PRIOR ART)
FIG. 7 is a partial cross-sectional view of the floor drain installation of the prior art shown in FIG. 6 which is embedded in concrete.

FIGS. 3, 4 and 5 illustrate a floor drain support pan or plate 30 that can be adapted to fasten to a receptacle body 12 of a prior art floor drain 10 as shown in FIGS. 6 and 7. The support plate 30 of FIGS. 3, 4 and 5 includes a body 32 having an outer surface 34 and an inner surface 36 and defining a first portion 38 and a second portion 40. The first portion 38 of the body 32 is preferably disc-shaped and defines a peripheral edge 42. The second portion 40 of the body 32 defining an edge 44 is attached to the peripheral edge 42 of the first portion 38 of the body 32 and axially extends therefrom, wherein the inner surface 36 of the body 32 defines an interior cavity 46 (shown in FIGS. 6 and 7). An annular flange 48 is attached to the edge 44 of the second portion 40 and extends in a direction away from the interior cavity 46 of the body 32 of the support plate 30 (shown in FIG. 5). The first portion 38 of the body 32 may define a center passageway 50 which is shown in phantom in FIGS. 3 and 4 and spaced radially away from the peripheral edge 42. The center passageway 50 may vary in size and shape in order to accommodate various sizes and shapes of pipes, more about which will be discussed hereinbelow.

Referring to FIGS. 3-7 the first portion 38 of the body 32 of support plate 30 can also define a plurality of slots 52, 52' shown in phantom in FIGS. 3 and 4 adjacent the peripheral edge 42. Slots 52, 52' are adapted to receive a fastener 62 for securing the support plate 30 to the receptacle body 12 of the floor drain 10 as shown in FIGS. 6 and 7. Slots 52, 52' may vary in size, shape and number in order to accommodate different sized and shaped floor drains. The slots 52' may be positioned around a circle having a different radius than a circle on which slots 52 are positioned, wherein the circles are coaxial with each other. The annular flange 48 also defines a plurality of flange slots 54 (preferably four) adapted to receive a fastener, such as a nail N, for securing the support plate 30 to a board B as shown in FIGS. 6 and 7. The support plate 30 may be made of a unitary piece of metal or plastic.

Referring again to FIGS. 3 and 4, the first portion 38 of the body 32 of the support plate 30 may include a plurality of concentric score lines 56 defined on the inner surface 36 and the outer surface 34 of support plate 30. These score lines 56 are concentrically arranged relative to each other and relative to the center passageway 50. Score lines 56 may vary in size, number and shape in order to accommodate different sized and shaped pipe. Initially, before support plate 30 is arranged in the drain plate support assembly of FIGS. 6 and 7, center passageway 50 does not exist, that is, a center circle CC defined by the innermost score line 56 is intact in the first portion 38 of body 32 of support plate 30. To form center passageway 50, this center circle CC is punched out and removed. The remaining score lines 56 can then be optionally punched out and removed to widen center passageway 50 to accommodate the diameter of the drain pipe. That is, when the center circle CC of the first portion 38 of body 32 of support plate 30 is removed along one of the innermost score lines 56, a center passageway 50 is formed, and the diameter of this center passageway 50 can be increased by removing one or more score lines 56 to accommodate drain pipes of various sizes. Alternatively, the appropriate section defined by one of the score lines 56 can be cut or punched out. Also, the body 32 of the support plate 30 need not include any score lines 56, whereby support plate 30 will be initially manufactured with a pre-formed center passageway 50.

Figure 1:
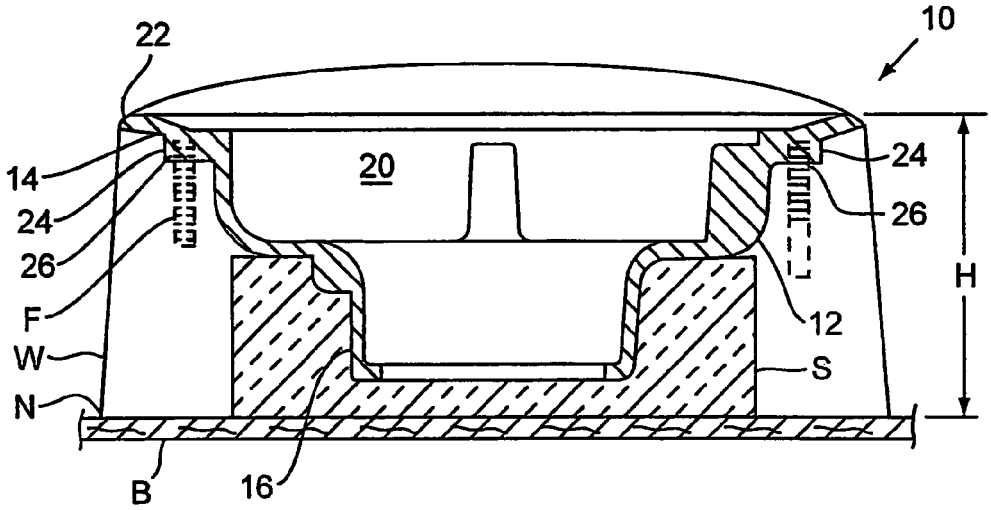
FIG. 1 (PRIOR ART)
FIG. 1 is a partial cross-sectional view of a floor drain installation of the prior art.
Figure 2:
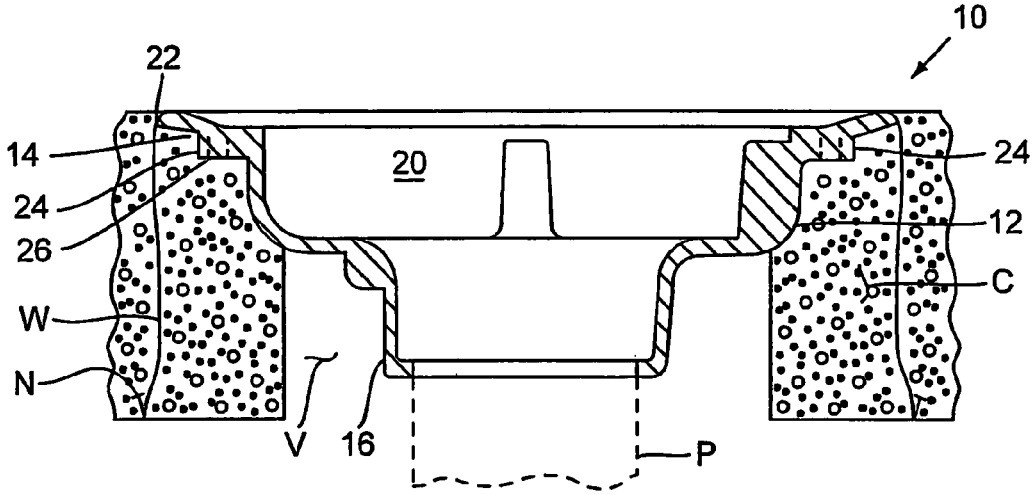
FIG. 2 (PRIOR ART)
FIG. 2 is a partial cross-sectional view of the floor drain installation of the prior art shown in FIG. 1 which is embedded in concrete.

FIGS. 6 and 7 particularly illustrate a floor drain support plate assembly 60 that includes drain 10 of the prior art of FIGS. 1 and 2. Drain 10 is attached to a support plate 30 via fastener 62. Two such elongated members or fasteners 62 are shown in FIGS. 6 and 7, but it is to be understood that as many as four such elongated members or fasteners may be provided. Each elongated member 62 has a first threaded end 63, a threaded middle portion 63', and a second end 63". The first threaded end 63 of each elongated member 62 is received within a threaded passageway 26 of the protrusion 24 of the receptacle body 12. The second end 63" of the elongated member 62 extends through slot 52 or 52' in the first portion 38 of the body 32 of support plate 30, with the threaded middle portion 63' of each elongated member 62 in proximity to support plate 30. A first flange nut 64 is threadably secured to the threaded middle portion 63' of each elongated member 62 and abuts the outer surface 34 of the body 32 of the support plate 30 and a second flange nut 64' is threadably secured to the threaded middle portion 63' of each elongated member 62 and abuts the inner surface 36 of the body 32 of the support plate 30. The fastener 62 preferably is a threaded fastener that is received in the threaded passageway 26 of the protrusion 24 of receptacle body 12. However, it is contemplated that fastener 62 can be formed in the receptacle body 12 for engagement in slots 52, 52' for attaching the receptacle body 12 to the support plate 30. The distance D shown in FIG. 6 between the top of receptacle body 12 and the bottom of support plate 30 can be adjusted by moving the flange nuts 64, 64' longitudinally along the threaded middle portion 63' of each fastener 62.

Still referring to FIGS. 6 and 7, the drain support plate assembly 60 further includes a pipe connection 66 attached inwardly relative to the second end 16 of the receptacle body 12. Pipe connection 66 may generally be annular and extends concentrically through the center passageway 50 of the body 32 of the support plate 30. According to conventional practice, the pipe connection 66 is adapted to be connected through conventional means to a drain pipe P shown in phantom in FIG. 7. An annular pipe spacer 68 also shown in phantom in FIG. 7 may be concentrically positioned around the second end 16 of the receptacle body 12. Pipe spacer 68 is spaced away from the second end 16 of the receptacle body 12 and extends between the second end 16 of the receptacle body 12 and fasteners 62 mounted in the support plate 30. Pipe spacer 68 may be made of plastic.

The invention of FIGS. 3-7 also provided for installing a floor drain 10 in a floor structure utilizing the support plate 30 as disclosed hereinabove. First, the size of a drain pipe is determined, for example a 2 inch, 3 inch, 4 inch or 6 inch pipe, and the support plate 30 having a center passageway 50 corresponding to the size and shape of the drain pipe is provided. Alternatively, if the plate 30 contains several concentric score lines 56 as shown in FIGS. 3 and 4, then the center circle CC defining the center passageway 50 is first removed along the innermost score line 56, and depending on whether the diameter of the center passageway 50 is to be increased to accommodate the diameter of the drain pipe, one or more concentric score lines 56 can be removed to widen the opening of center passageway 50.

A further step for installing floor drain 10 in a floor structure involves aligning each passageway 26 in each protrusion 24 of the receptacle body 12 with a respective slot 52 or 52' in the first portion 38 of the body 32 of the support plate 30 and using the fasteners 62 to attach the receptacle body 12 to the support plate 30. In order to attach the receptacle body 12 to the support plate 30, the first flange nut 64 is mounted onto the threaded middle portion 63' of the fastener 62 and the first threaded end 63 of the fastener 62 is screwed into a threaded passageway 26 of the protrusion 24 of the receptacle body 12. The second end 63" of the fastener 62 then passes through a slot 52 or 52' in the support plate 30 with the first flange nut 64 abutting against the outer surface 34 of the first portion 38 of the body 32 of the support plate 30.

As particularly shown in FIG. 6, the distance D between the receptacle body 12 and the support plate 30 is increased or decreased by longitudinally moving the first flange nut 64 in either direction represented by the double-headed arrow A along the fastener 62. Once the appropriate distance D is determined, a second flange nut 64' is mounted onto the second end 63" of the fastener 62 and moved upward toward and along the threaded middle portion 63' of the fastener 62 and toward the inner surface 36 of the body 32 of the support plate 30, thereby fixing the distance D between the top of receptacle body 12 and the bottom of support plate 30. This distance D can be adjusted further by longitudinally moving both flange nuts 64, 64' along their respective fastener 62.

Still referring to FIGS. 3-7, a still further step for installing floor drain 10 in a floor structure involves connecting the pipe connection 66 to the second end 16 of the receptacle body 12, wherein the pipe connection 66 extends through the center passageway 50 of the body 32 of the support plate 30. Pipe connection 66 generally will be used to connect a drain pipe P to the receptacle body 12. As shown particularly in FIG. 6, sealant SL, such as rubber or foam, can be placed between the pipe connection 66 and the center passageway 50 of the support plate 30 in order to fill in any gaps that exist. Even though pipe connection 66 is shown in FIGS. 6 and 7, it is also envisioned that pipe connection 66 does not need to be installed for a drain pipe P to be connected to receptacle body 12 in the future.

Still referring to FIGS. 3-7, a still further step for installing the floor drain 10 in a floor structure involves fastening the support plate 30 to a board B via one or more fasteners, such as a nail N, extending through the flange slot 54 in the annular flange 48 of the body 32 of the support plate 30 as particularly shown in FIGS. 6 and 7. Once the support plate 30 is secured to board B, concrete C is then poured around the receptacle body 12 and the support plate 30 as particularly illustrated in FIG. 7. As shown in FIG. 7, support plate 30 prevents any concrete C from contacting a portion of the pipe connection 66 that extends into the interior cavity 46 of the body 32 of the support plate 30, thereby creating or maintaining an empty space in interior cavity 46 of support plate 30. This empty space created in the underside of the concrete slab allows for a drain pipe P to be connected in the future to pipe connection 66 after the concrete has been poured. Also as shown in FIG. 7, the concrete C extends between elongated members 62 and against a portion of the second end 16 of receptacle body 12 and a portion of pipe connection 66. However, if the pipe spacer 68 as shown in phantom is concentrically positioned around the second end 16 of the receptacle body 12 and the pipe connection 66, it will prevent any concrete C from entering into the area created by the pipe space 68 and the second end 16 of receptacle body 12 and pipe connection 66, thereby creating a void V. The existence of this void V will allow pipe connection 66 to be easily removed from the second end 16 of receptacle body 12 without having to remove any concrete C from around pipe connection 66.

After the concrete C, present within the floor drain support plate assembly 60 of FIG. 7, is cured, the board B is removed from the underside of the floor structure, and the second end 63" of the elongate members 62 and nails N may be trimmed if necessary.

The drain support plate assembly 60 of the invention allows an installer to level and/or adjust the floor drain 10 to a required height H or distance D relative to the support plate 30 prior to its installation within the floor structure and prior to the pouring of the concrete. Further, the drain support plate assembly 60 also prevents the location of the floor drain 10 from becoming altered and the floor drain 10 from being damaged or stepped on before the concrete is poured since the support plate 30 and elongated members 62 form a barrier around floor drain 10. Additionally, as is apparent from the above discussion, the support plate 30, elongated members 62 and floor drain 10 can be installed into the floor structure as a unit.

Figure 8:
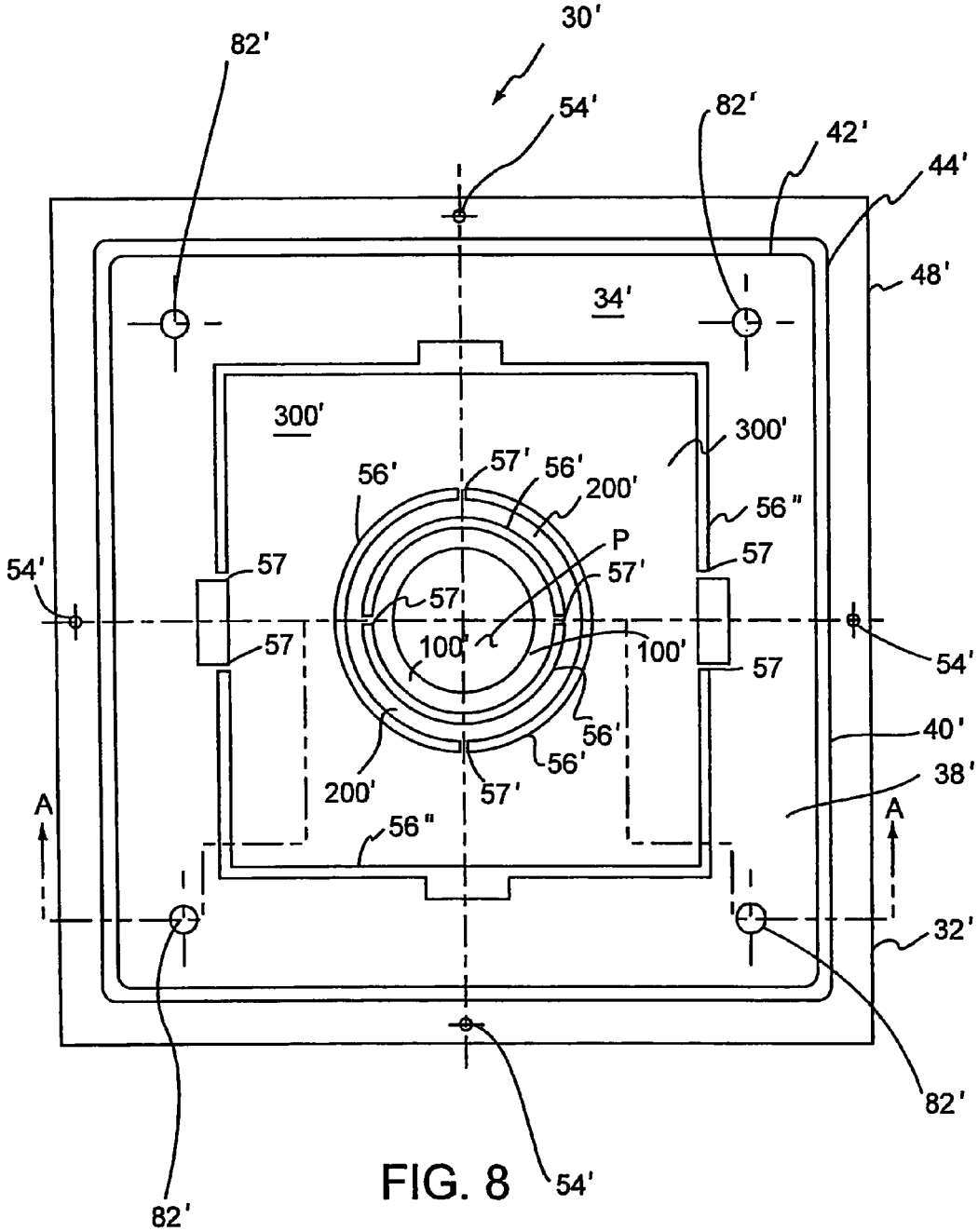
FIG. 8 is a top plan view of a drain body support pan made in accordance with the present invention.
Figure 9:
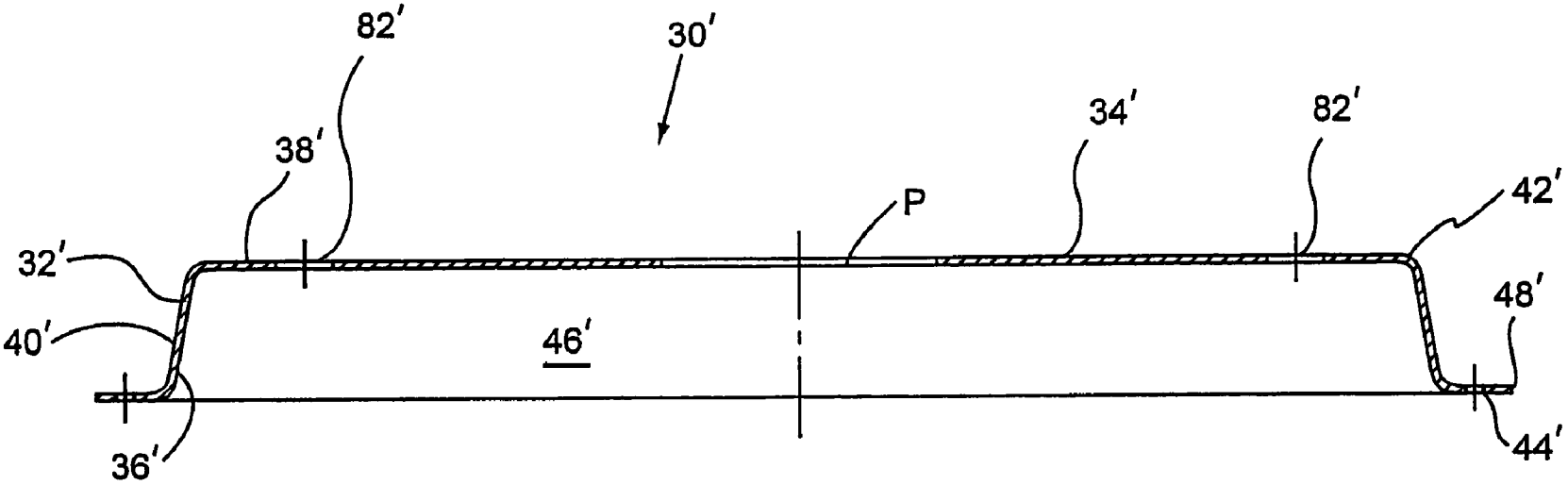
FIG. 9 is a section taken along lines A-A in FIG. 8.
Figure 10:
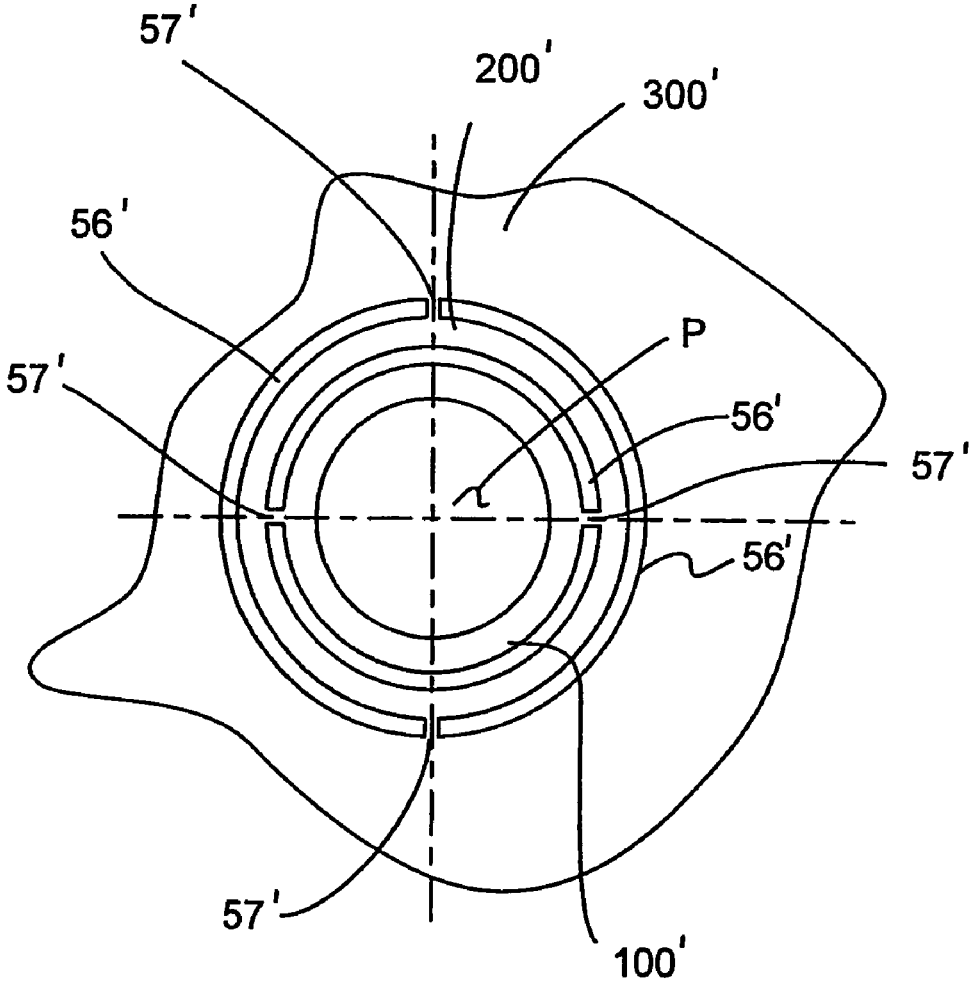
FIG. 10 is a top plan, partial view of the drain body support pan of the present invention shown in FIG. 8.

FIGS. 8-12 represent the present invention. As particularly illustrated in FIGS. 8-10, a drain body support plate assembly 60' of FIGS. 11 and 12 includes a rectangular-shaped support plate or pan 30'. This rectangular-shaped pan 30' is similar to disc-shaped plate 30 shown in FIGS. 3-7 except for the differences discussed hereinbelow. Referring in particular to FIG. 9, the drain body support pan 30' has a body 32' having an outer surface 34' and an inner surface 36' and defining a first portion 38' and a second portion 40'. Referring to FIG. 8, the first portion 38' of the body 32' is rectangular-shaped and includes a rectangular-shaped peripheral edge 42'. Referring to both FIGS. 8 and 9, the second portion 40' of the body 32' defines a rectangular-shaped edge 44' which is attached to the peripheral edge 42' of the first portion 38' of the body 32' and axially extends therefrom, and the inner surface 36' of the body 32' defines an interior cavity 46' as best shown in FIG. 9. As shown in FIGS. 8 and 9, a rectangular-shaped flange 48' is attached to edge 44' of the second portion 40' and extends in a direction away from the interior cavity 46' of the body 32' of the drain body support pan 30'. The first portion 38' of the body 32' of the support pan 30' includes a central passageway P and, as shown in FIG. 8, concentric perforations 56' are provided around central passageway P. These concentric perforations 56' define first geometric shaped, i.e., circular knock-out sections 100' and 200' which may be removed to widen the central passageway P to form a circular opening capable of receiving a larger diameter drain pipe or drain connection. Also, perforations 56" define a geometric shaped knock-out, i.e., rectangular-shaped section 300' and are provided so that when this rectangular knock-out section 300' is removed, a rectangular opening is formed in the support plate 30' for receiving a rectangular-shaped receptacle body 12', such as that of A.R.E. SANI-FLOR™ Receptors Z1900, Z1901 or Z1902, which are drain receptacles having a coating that provides excellent resistance to acids, abrasions, and wear and are commonly used in environments where extreme sanitation is necessary, e.g. commercial kitchens and hospitals, provided by Zurn Industries, Inc., more about which is discussed hereinbelow. Except for these aforesaid differences for the configuration of the rectangular support plate 30' of FIGS. 8-12, the installation and operation of the drain body support pan 30' for these Receptors Z1900, Z1901 and Z1902 is essentially similar to that disclosed hereinabove for the drain body support pan 30 of FIGS. 3-7 of the '894 patent application.

The perforations 56' and 56" pass completely through the drain body support pan 30'. However, the perforations 56' and 56" are spaced by small solid sections 57' to enable easy removal of the corresponding circular knock-out sections 100', 200' and rectangular knock-out section 300' as indicated particularly in FIG. 10. Score lines may be used in lieu of perforations 56' and 56" and solid sections 57'. Even though the second geometric shaped knock-out section 300' is shown as being rectangular, such as a square, it is to be appreciated that it can take any other geometric shape corresponding to the profile of the receptacle body 12'. As also shown in FIG. 8, pan 30' also has four holes or slots 82' for receiving fasteners 600' shown in FIGS. 11 and 12.

Figure 12:
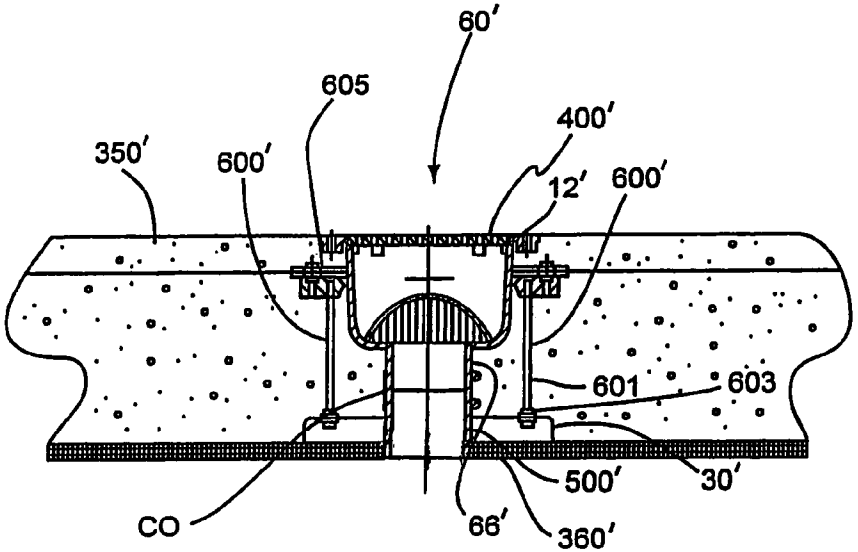
FIG. 12 is a partial floor drain arrangement utilizing the drain body support pan shown in FIGS. 8-10 for a deep floor structure.
Figure 11:
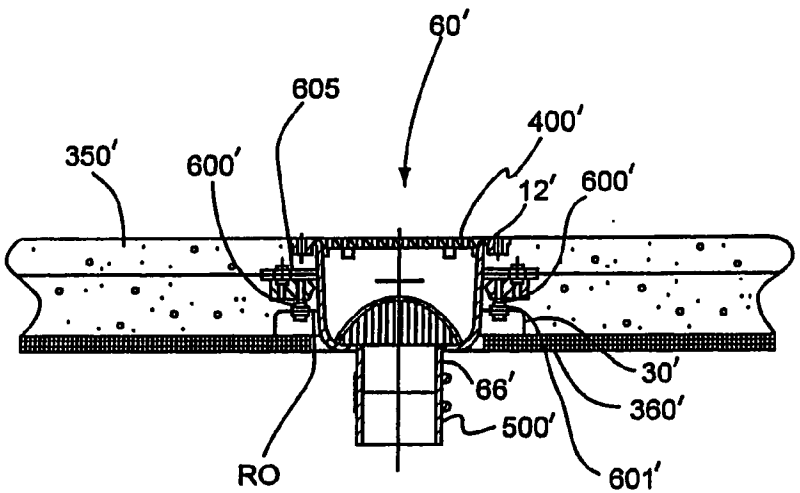
FIG. 11 is a partial floor drain arrangement utilizing the drain body support pan shown in FIGS. 8-10 for a narrow floor structure.

FIGS. 11 and 12 illustrate a drain support plate assembly 60' including a drain body support pan 30', which is installed with a Receptor Z1900, indicated at reference number 400'. The receptor 400' is embedded in a concrete form 360'. The receptacle body 12' of the receptor 400' has a rectangular profile. In FIG. 11, a portion of the receptacle body 12' along with a pipe connection 66' passes through pan 30' and the receptacle body 12' is supported on the concrete form 360'. In this arrangement of FIG. 11, the rectangular knock-out section 300' in drain body support pan 30' (FIG. 8) is removed so that the pipe connection 66' and the receptacle body 12' can pass through pan 30' and the receptacle body 12' can be supported in and by pan 30'.

This arrangement of FIG. 11 may be installed in a narrow floor space of a floor structure. A pipe 500' is attached to the pipe connection 66' at the lower end of the receptor 400', and receptor 400' is secured in pan 30' by fasteners 600'.

Even though FIGS. 11 and 12 show only two fasteners 600', it is to be appreciated that four such fasteners 600' may be provided. Each fastener 600' includes an elongated member 601 whose length will vary depending on whether the drain support plate assembly 60' is installed in a narrow floor structure as illustrated in FIG. 11 or in a deep floor space as illustrated in FIG. 12. The elongated member 601 of fasteners 600' preferably is a threaded stud and each fastener 600' further includes a nut assembly 603. As illustrated in FIGS. 11 and 12, the threaded stud or elongated member 601 of fastener 600' extends in one of slots or holes 82' of the pan 30' (FIG. 8) and is secured therein via nut assembly 603. The other end of elongated member 601 is threadably secured in the receptacle body 12' of receptor 400' as indicated as reference number 605.

FIG. 12 shows a drain support plate assembly 60' installed within a deep floor space of the floor structure. Drain support plate assembly 60' includes drain body support pan 30' of the invention where the pipe 500' passes directly through a stabilizer section 100' of support pan 30' (FIG. 8). The receptor 400' which includes the receptacle body 12' and pipe connection 66' is held above the pan 30' by the fasteners 600'. Referring particularly to FIG. 8, the corresponding circular knock-out sections 100' and 200' only need to be removed so that the pipe 500' can pass through the pan 30' in a manner similar to that of the embodiment described hereinabove with respect to FIGS. 3-7. As is apparent, for a small diameter pipe 500', only knock-out section 100' will be removed and for a larger diameter pipe 500', both knock-out sections 100' and 200' will be removed.

As can be appreciated, the receptacle body 112' of drain receptor 400' which generally has a rectangular profile will extend through the rectangular knocked-out section 300' of the pan 30' of FIG. 8 in order for the drain support plate assembly 60' to be installed in a narrow floor space of a floor structure of FIG. 11. Whereas, pipe 500' will pass through the circular knocked-out sections 100' and 200' of pan 30' of FIG. 8 in order for the drain support plate assembly 60' to be installed in a deep floor space of the floor structure of FIG. 12. When rectangular knock-out section 300' of pan 30' is removed, the center passageway P and the concentric knock-out sections 100' and 200' defined in the first portion of the body of the drain body support pan 30' will also be removed. Also, the drain plate assembly arrangement 60' of FIG. 11 for a narrow floor space shows that the elongated members 601 of the fasteners 600' are short compared to the elongated members 601 of the fasteners 600' of the drain plate assembly arrangement 60' of FIG. 12 for a deep floor space.

A method for installing the drain support plate assembly 60' of the invention of FIGS. 8-12 includes the steps of first determining whether the depth of the floor space is considered as being a narrow floor space or a deep floor space. If the depth of the floor space is considered as being a narrow floor space, then rectangular knock-out section 300' of the body of the drain body support pan 30' is removed, and the rectangular-shaped receptacle body of the drain receptor is inserted in the formed rectangular opening as shown at RO in FIG. 11. If the depth of the floor space is considered as being a deep floor space, then the pipe 500' and/or pipe connection 66' is inserted into the center passageway P of the drain body support pan 30', and, optionally, one or more circular perforated sections 100' and 200' of the body 32' of the support pan 30' are removed thereby forming a circular opening as shown at CO in FIG. 12. The drain receptor 400' and the support pan 30' are secured together through one or more fasteners 600', and cement is poured into the area of the floor space above the support pan 30' as indicated in FIGS. 11 and 12. As indicated hereinabove, a shorter length of the elongated member 601 of the fasteners 600' will be chosen for the arrangement of FIG. 11 compared to that of FIG. 12.

Once the drain support assembly 60' with the drain body support pan 30' of FIGS. 8-12 is assembled, the concrete is poured and the support pan 30' can be nailed down to the concrete forms 360' by using the nail holes 54' in rectangular flange 48' of support pan 30' (FIG. 8). After the concrete C is set and the concrete forms 360' are stripped away, the result will be a voided area on the underside of the floor with a stub of pipe protruding through the floor. Any nails that are extended beyond the concrete floor can be trimmed off, and the remaining drainage line can be connected to the receptacle body 12' of the receptor drain.

The drain support plate assemblies 60' including the support pan 30' of FIGS. 8-12 provide greater flexibility for varying floor depths in floor structures compared to that of the prior art. Even though not shown in FIGS. 8-12, a pipe spacer may also be provided similar to that disclosed hereinabove relative to the prior art drain support plate assembly 60 of FIGS. 3-7. Even though center passageway P and the first geometric shaped knock-out sections 100' and 200' are disclosed as being circular in drain support pan 30', it is to be appreciated that the center passageway P and knock-out sections 100' and 200' may also be rectangular in shape (or other shape) if the pipe connection 66' and drain pipe 500' for some reason have a rectangular profile. Likewise, the shape of the support pan 30' may be circular, such as support plate 30 of FIGS. 3-7. Also, the first geometric shaped concentric knock-out sections 100' and 200' have a first area and the second geometric shaped knock-out section 300' has a second area wherein the first area is less than the second area. For example, if the knock-out sections 100' and 200' are in the shape of a circle, then the standard area of a circle would apply. If the knock-out section 300' is a square or a rectangle, then the standard area for these shapes would apply.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A drain body support pan adapted to be connected to a receptacle body of a drain, the drain body support pan comprising:

a body having an inner surface and an outer surface and defining a first portion and a second portion, said first portion of said body defining a peripheral edge, said second portion of said body attached to the peripheral edge of said first portion and axially extending from said peripheral edge of said first portion, wherein said inner surface of said first portion and said second portion of said body define an interior cavity, wherein said first portion of said body of said drain body support pan defines a center passageway spaced inwardly of said peripheral edge of said first portion of said drain body support pan and adapted to receive a pipe or pipe connection, wherein at least one first geometric shaped knock-out section is defined on said first portion adjacent said center passageway of said body of said drain body support pan and is adapted to be removed from said drain body support pan, wherein at least one second geometric shaped knock-out section is defined on said first portion outwardly of said at least one first geometric shaped knock-out section and inwardly of said peripheral edge of said first portion of said body of said drain body support pan and is adapted to be removed from said support pan, said first geometric shaped knock-out section having a different geometric shape than the second geometric shaped knock-out section, wherein said second geometric shaped knock-out section is configured to receive at least a portion of the drain receptacle body of the drain; and wherein said drain body support pan is configured for use for installing a drain support assembly in both a narrow floor structure and/or a deep floor space.

2. The drain support plate as claimed in claim 1, wherein said first portion of said body of said drain body support pan contains at least one slot adapted to be aligned with said receptacle body for receiving a fastener for attaching said receptacle body to said body of said drain body support pan.

3. The drain support plate as claimed in claim 1, wherein at least two first geometric shaped concentric knock-out sections are defined on said first portion adjacent said center passageway of said body of said support pan.

4. The drain body support pan as claimed in claim 3, wherein said at least two first geometric shaped knock-out sections are defined by a plurality of perforations extending from said outer surface to said inner surface of said first portion and adapted for removal of one or more first geometric shaped knock-out sections for enlarging the diameter of said center passageway of said body of said support pan.

5. The drain body support pan as claimed in claim 4, wherein said center passageway is circular.

6. The drain body support pan as claimed in claim 5, wherein said at least one second geometric shaped knock-out section is defined by a plurality of perforations extending from said outer surface to said inner surface of said first portion adapted for removal of said second geometric shaped knock-out section which involves removal of said one or more first geometric shaped knock-out sections and said center passageway of said body of said support pan.

7. The drain body support pan as claimed in claim 1, wherein said body is rectangular.

8. The drain body support pan as claimed in claim 7, wherein said first geometric shaped knock-out section is circular.

9. The drain body support pan as claimed in claim 7, wherein said second geometric shaped knock-out section is rectangular.

10. The drain body support pan as claimed in claim 9, wherein said second geometric shaped knock-out section is square.

11. The drain body support pan as claimed in claim 9, wherein said first geometric shaped knock-out section is circular.

12. The drain body support pan as claimed in claim 1, wherein said first geometric shaped knock-out section has a first area and said second geometric shaped knock-out section has a second area, the first area being less than the second area.

13. The drain body support pan as claimed in claim 3, wherein said at least two first geometric shaped concentric knock-out sections are geometrically similar.

14. A drain body support pan assembly comprising:

a receptacle body having a drain pipe and/or a pipe connection, and a drain support pan connected to the receptacle body, said drain support pan comprising:

a body having an inner surface and an outer surface and defining a first portion and a second portion, said first portion of said body defining a peripheral edge, said second portion of said body attached to the peripheral edge of said first portion and axially extending from said peripheral edge of said first portion, wherein said inner surface of said first portion and said second portion of said body define an interior cavity, wherein said first portion of said body of said drain body support pan defines a center passageway spaced inwardly of said peripheral edge of said first portion of said drain body support pan and adapted to receive the pipe or pipe connection, wherein at least one first geometric shaped concentric knock-out section is defined on said first portion adjacent said center passageway of said body of said drain body support pan and is adapted to be removed from said drain body support pan, wherein at least one second geometric shaped knock-out section is defined on said first portion outwardly of said at least one first geometric shaped knock-out section and inwardly of said peripheral edge of said first portion of said body of said drain body support pan and is adapted to be removed from said support pan, said first geometric shaped knock-out section having a different geometric shape than the second geometric shaped knock-out section, and wherein said drain body support pan is configured for use for installing a drain support assembly in both a narrow floor structure and/or a deep floor space; and wherein said second geometric shaped knock-out section is configured for receiving at least a portion of said receptacle body.

15. The drain support pan assembly as claimed in claim 14, further comprising at least one fastener connecting said receptacle body to said drain support pan.

16. The drain support plate assembly as claimed in claim 15, wherein said first portion of said body of said drain body support pan contains at least one slot adapted to be aligned with said receptacle body for receiving said at least one fastener for connecting said receptacle body to said drain body support pan, and wherein said fastener has a length that is varied depending on the depth of the floor space in which said drain support plate assembly is installed.

* * * * *

UNITED STATES PATENT AND TRADEMARK OFFICE

CERTIFICATE OF CORRECTION

PATENT NO. : 7,958,686 B1
APPLICATION NO. : 11/803342
DATED : June 14, 2011
INVENTOR(S) : Christopher A. Majocka It is certified that error appears in the above-identified patent and that said Letters Patent is hereby corrected as shown below:

Column 12, Lines 29-30, Claim 14, “section, and” should read -- section; --

Signed and Sealed this
Eighteenth Day of October, 2011

David J. Kappos

David J. Kappos
*Director of the United States Patent and Trademark Office*